US007275384B2

(12) United States Patent
Taras et al.

(10) Patent No.: US 7,275,384 B2
(45) Date of Patent: Oct. 2, 2007

(54) HEAT PUMP WITH REHEAT CIRCUIT

(75) Inventors: Michael F. Taras, Fayetteville, NY (US); Alexander Lifson, Manlius, NY (US)

(73) Assignee: Carrier Corporation, Syracuse, NY (US)

( * ) Notice: Subject to any disclaimer, the term of this patent is extended or adjusted under 35 U.S.C. 154(b) by 277 days.

(21) Appl. No.: 10/942,436

(22) Filed: Sep. 16, 2004

(65) Prior Publication Data

US 2006/0053820 A1 Mar. 16, 2006

(51) Int. Cl.
*F25B 13/00* (2006.01)
*F25B 29/00* (2006.01)
*F25D 17/06* (2006.01)

(52) U.S. Cl. ..... 62/324.1; 62/324.6; 62/159; 62/90

(58) Field of Classification Search ..... 62/324.1, 62/324.6, 159, 196.4, 90, 92, 93
See application file for complete search history.

(56) References Cited

U.S. PATENT DOCUMENTS 3,264,840 A 8/1966 Harnish
4,876,859 A 10/1989 Kitamoto
5,094,085 A 3/1992 Irino
5,095,721 A 3/1992 Negri
5,157,933 A 10/1992 Brendel
5,622,057 A 4/1997 Bussjager et al.
5,752,389 A * 5/1998 Harper ..... 62/176.5
5,875,637 A 3/1999 Paetow
5,953,926 A 9/1999 Dressler et al.
6,055,818 A 5/2000 Valle
6,206,652 B1 3/2001 Caillat
6,276,148 B1 8/2001 Shaw
6,381,970 B1 5/2002 Eber et al.
6,422,308 B1 7/2002 Okawara et al.
6,427,461 B1 8/2002 Whinery et al.
6,595,012 B2 7/2003 Rafalovich
6,644,049 B2 * 11/2003 Alford ..... 62/173
6,701,723 B1 3/2004 Dobmeier et al.
6,705,093 B1 3/2004 Taras et al.
6,941,770 B1 9/2005 Taras et al.
2003/0136140 A1 7/2003 Maeda
2006/0053820 A1 3/2006 Taras (Continued)

FOREIGN PATENT DOCUMENTS

JP 56051963 A * 5/1981

*Primary Examiner*—Chen Wen Jiang
(74) *Attorney, Agent, or Firm*—Carlson, Gaskey, & Olds

(57) ABSTRACT

A refrigerant heat pump system is operable in both heating and cooling modes. A reheat circuit is integrated into the system schematic to provide improved control over temperature and humidity and to cover a wide spectrum of sensible and latent capacity demands. In the heating mode, the reheat coil is utilized to act as a portion of the enlarged indoor heat exchanger (a condenser in this case), in order to enhance system efficiency without the capacity loss. In some cases, where the designer can choose between the efficiency and capacity augmentation, selective operation of the reheat coil may offer an additional step of capacity modulation, in the heating mode. System reliability is improved through a reduction of start/stop cycles. Although various reheat coil arrangements in relation to the indoor and outdoor heat exchangers are offered and reheat concepts are considered, the benefits of the invention are independent from and transparent to such system design features.

20 Claims, 2 Drawing Sheets

U.S. PATENT DOCUMENTS

2006/0053821 A1* 3/2006 Taras et al. ..... 62/324.1
2006/0053822 A1 3/2006 Taras
2006/0053823 A1 3/2006 Taras

* cited by examiner

HEAT PUMP WITH REHEAT CIRCUIT

BACKGROUND OF THE INVENTION

This invention relates to a heat pump system that is operable in both cooling and heating modes, with a reheat coil incorporated into the system schematic and selectively utilized in both aforementioned modes of operation to provide the benefits of precise temperature and humidity control, performance enhancement, reliability improvement and capacity modulation.

Refrigerant systems are utilized to control the temperature and humidity of air in various indoor environments to be conditioned. In a typical refrigerant system operating in the cooling mode, a refrigerant is compressed in a compressor and delivered to a condenser (or an outdoor heat exchanger in this case). In the condenser, heat is exchanged between outside ambient air and the refrigerant. From the condenser, the refrigerant passes to an expansion device, at which the refrigerant is expanded to a lower pressure and temperature, and then to an evaporator (or an indoor heat exchanger). In the evaporator, heat is exchanged between the refrigerant and the indoor air, to condition the indoor air. When the refrigerant system is operating, the evaporator cools the air that is being supplied to the indoor environment. In addition, as the temperature of the indoor air is lowered, moisture usually is also taken out of the air. In this manner, the humidity level of the indoor air can also be controlled.

The above description is of a refrigerant system being utilized in a cooling mode of operation. In the heating mode, the refrigerant flow through the system is essentially reversed. The indoor heat exchanger becomes the condenser and releases heat into the environment to be conditioned (heated in this case) and the outdoor heat exchanger serves the purpose of the evaporator and exchangers heat with a relatively cold outdoor air. Heat pumps are known as the systems that can reverse the refrigerant flow through the refrigerant cycle, in order to operate in both heating and cooling modes. This is usually achieved by incorporating a four-way reversing valve (or an equivalent device) into the system schematic downstream of the compressor discharge port. The four-way reversing valve selectively directs the refrigerant flow through indoor or outdoor heat exchanger when the system is in the heating or cooling mode of operation respectively. Furthermore, if the expansion device cannot handle the reversed flow, then a pair of expansion devices, each along with a check valve, is to be employed instead.

In some cases, while the system is operating in the cooling mode, the temperature level, to which the air is brought to provide a comfort environment in a conditioned space, may need to be higher than the temperature that would provide the ideal humidity level. This has presented design challenges to refrigerant system designers. One way to address such challenges is to utilize various schematics incorporating reheat coils. In many cases, the reheat coils, placed on the way of indoor air stream behind the evaporator, are employed for the purpose of reheating the air supplied to the conditioned space, after it has been cooled in the evaporator, and where the moisture has been removed.

While reheat coils have been incorporated into the air conditioning systems operating in the cooling mode, they have not been utilized in the heat pump systems, that are operable in both cooling and heating modes, to achieve (in addition to precise control over temperature and humidity) performance enhancement, reliability improvement and capacity modulation in both aforementioned modes of operation. Also, the system control associated with such heat pumps has generally not been well-developed.

SUMMARY OF THE INVENTION

In a disclosed embodiment of this invention, a heat pump system is operable in either a cooling or heating mode by reversing the flow of refrigerant from the compressor through the circuit, utilizing a main flow control device such as a four-way reversing valve. A reheat coil is incorporated into the system schematic, and is selectively operated in both cooling and heating modes of operation.

In the cooling mode, the reheat coil receives a flow of a relatively hot refrigerant in a vapor, liquid or two-phase state and reheats an airflow (by means of heat transfer interaction with this refrigerant) to a higher temperature than would otherwise be provided by the conventional design schematic. In general, the reheat coil allows for the dehumidified air to be supplied to an environment to be conditioned at a desired temperature. A stream of air is passed over an indoor heat exchanger, which will maintain the air at a low temperature, assuring enough moisture to be removed from the air, but in many cases at a temperature lower than desired in the conditioned environment. At least a portion of this air is then passed over the reheat coil, where it is reheated to the target temperature.

In the heating mode, the reheat coil is employed to act as a portion of an enlarged indoor heat exchanger (a condenser in this case), in order to enhance system performance by reducing the discharge pressure. The increased size of the combined indoor heat exchanger boosts the heat pump efficiency, usually without the capacity loss. In some cases, when a designer can choose between the efficiency and capacity augmentation, selective operation of the reheat coil may offer an additional step of capacity modulation in the heating mode.

In the heating mode of operation, the reheat coil can be utilized to improve the heat pump efficiency in a number of different arrangements. The present invention provides a variety of system configurations, where separate taps and return points for the reheat coil, along with associated refrigerant flow control devices, are employed. In this way, a system designer has the option of using a reheat coil with the refrigerant having different thermo-physical properties and flow patterns. In embodiments, the reheat coil can be in either serial or parallel communication with the indoor and outdoor heat exchangers, and the refrigerant may flow through the reheat coil in the same or opposite direction, depending on the mode of operation. Again, a worker of ordinary skill in the art would recognize how this would provide beneficial control options.

The following specification and drawings are not intended to cover a wide variety of the known reheat circuit designs and system configurations and only show exemplary circuit schematics to convey the benefits obtained from the teachings of this invention.

These and other features of the present invention can be best understood from the following specification and drawings, the following of which is a brief description.

DETAILED DESCRIPTION OF THE PREFERRED EMBODIMENT

Figure 1:
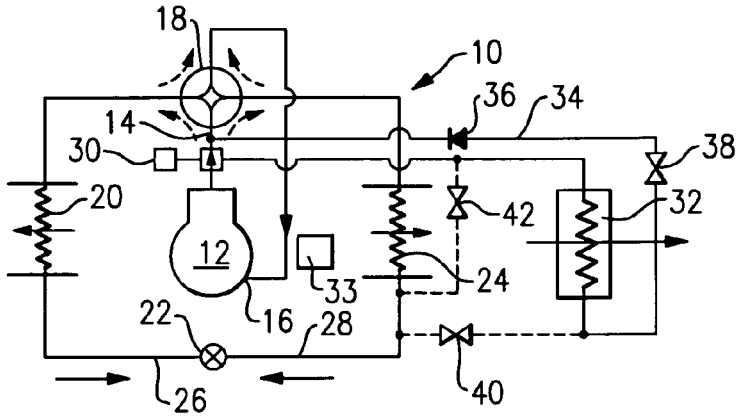
FIG. 1 shows a first schematic.

FIG. 1 shows a heat pump system 10 incorporating a compressor 12 delivering compressed refrigerant to a discharge line 14, and receiving a refrigerant to be compressed from a suction line 16. A main flow control device such as a four-way reversing valve 18 routes the refrigerant to either an outdoor heat exchanger 20 or an indoor heat exchanger 24, as shown, in a cooling or heating mode of operation respectively. In the cooling mode, the refrigerant passes from the discharge line 14 through the four-way reversing valve 18, and downstream to an outdoor heat exchanger 20. Downstream of the outdoor heat exchanger 20 is an expansion device 22, and downstream of the expansion device 22 is an indoor heat exchanger 24. The refrigerant is returned back to the compressor 12 again through the four-way reversing valve 18 and through the suction line 16. In the conventional cooling mode of operation, the air flowing over indoor heat exchanger 24 (an evaporator in this case) is cooled and usually dehumidified before it is supplied to the environment to be conditioned.

In the heating mode, the refrigerant passes from the discharge line 14, through the four-way valve 18, to the indoor heat exchanger 24, the expansion device 22, the outdoor heat exchanger 20, once again to the four-way valve 18, to the suction line 16, and finally back to the compressor 12. In the heating mode, the air flowing over the indoor coil 24 (a condenser in this case) is heated before entering the conditioned space.

As known in the art, in case the expansion device 22 cannot handle the reverse flow, it can be replaced by two assemblies, each containing a unidirectional expansion device and a check valve for control of refrigerant flow in the appropriate direction.

As shown in FIG. 1, the discharge line 14 incorporates a three-way valve 30 that selectively allows for at least a portion of refrigerant to be tapped off from the main refrigerant flow in line 14 to a reheat coil 32. This refrigerant flows through the reheat coil 32, through a refrigerant line 34 having an optional check valve 36, and returns to the line 14 of the main circuit. As known in the art, a three-way valve can be substituted by a pair of ON/OFF or regulating valves.

The reheat coil 32 is positioned to be in the path of air passing over the indoor heat exchanger 24 and driven by an air-moving device 33. The reheat coil is utilized in the cooling mode of operation when a system control determines that it would be desirable to predominantly have dehumidification of the air being supplied to an environment to be conditioned, while maintaining the temperature level. The system control manages the refrigerant flow and system operation such that the indoor heat exchanger 24 conditions the airflow heading to the indoor environment to be cooled and dehumidified with at least a portion of that air then being passed over the reheat coil, which reheats the air to a desired temperature for the environment. Thus, by utilizing reheat coil 32 in the cooling mode, the present invention provides better control over the operation of a heat pump system in terms of temperature and humidity, enhancing its operational flexibility and establishing a broader coverage of the external latent and sensible load demands. Although a hot gas reheat schematic, with the reheat coil positioned upstream of the outdoor heat exchanger in the cooling mode of operation, is shown in FIG. 1, the teachings of the invention, the benefits of which will become apparent below, are not related to any particular reheat system design and are transparent to any reheat concept and system configuration.

In the heating mode, at least a portion of refrigerant in the discharge line 14 is selectively redirected by the three-way valve 30 to flow through the reheat coil 32 to augment the heat pump efficiency, if desired. This refrigerant is then returned back to the discharge line 14 downstream of the three-way valve 30 through the refrigerant line 34 and the check valve 36. Consequently, the refrigerant continues through the heating cycle by flowing through the four-way reversing valve 18, indoor heat exchanger 24, expansion device 22, outdoor heat exchanger 20, four-way reversing valve 18 once again and finally back to the compressor 12. Thus, the combined reheat coil 32 and indoor heat exchanger 24 effectively represent an enlarged combined condenser, that allows for a discharge pressure (and consequently temperature) reduction and efficiency boost of the heat pump system 10. Although such efficiency augmentation usually is not associated with any capacity loss, in some rare cases, when a designer has to choose between the efficiency and capacity augmentation, selective operation of the reheat coil 32 may offer an additional step of capacity modulation at a higher efficiency level in the heating mode. Consequently, system efficiency and reliability can be improved through a reduction of start-stop cycles. Although this configuration is the most simplistic (since it doesn't require any additional hardware) and efficient (since, in the heating mode, refrigerant flow and air flow are arranged in a cross-counterflow manner for the heat transfer interaction) for the reheat cycle shown in FIG. 1, other refrigerant flow patterns and system component arrangements are also feasible, as will become apparent below.

As shown in FIG. 1, the heat pump system 10 is also provided with optional shut-off valves 40 and 42. Further, an optional shut-off valve 38 is placed on the line 34 and can replace the check valve 36. As can be appreciated, when the heat pump system 10 is operated in the heating mode, such that refrigerant flows from the three-way 30, through the reheat coil 32, and back to the discharge line 14 through the line 34 in the manner described above, the valve 40 and the valve 42 should be closed and the valve 38 should be open.

If it is desired to have the refrigerant flow in a parallel arrangement through the reheat coil 32 and indoor heat exchanger 24, then the valve 40 is opened, the three-way valve 30 is opened, and the valves 38 and 42 are closed. At least a portion of refrigerant can now flow from the three-way valve 30, through the reheat coil 32, and be returned through the now opened valve 40 to the refrigerant line 28 downstream of the indoor heat exchanger 24. Further, if it is desirable for the refrigerant to flow through the reheat coil 32 after having flowed through the indoor heat exchanger 24, then the valves 40 and 42 are opened to pass the refrigerant through the coil 32 with the three-way valve 30 and valve 38 being closed.

In addition, by closing the three-way valve 30 and valve 40 and opening the valves 38 and 42, the inlet and outlet refrigerant lines leading to the reheat coil 32 can be switched to provide more control and flexibility. (It has to be noted that the check valve 36 should not be present in this case.) Lastly, opening the valve 42 allows for a refrigerant bypass option around the reheat coil 32 in some of aforementioned system configurations, if desired.

It has to be understood that the system arrangements shown and evaluated above are exemplary and are considered for illustrative purposes only. Obviously, each system configuration can be employed separately, as well as many other schematics are feasible by adding refrigerant flow control devices and connecting lines.

Figure 2:
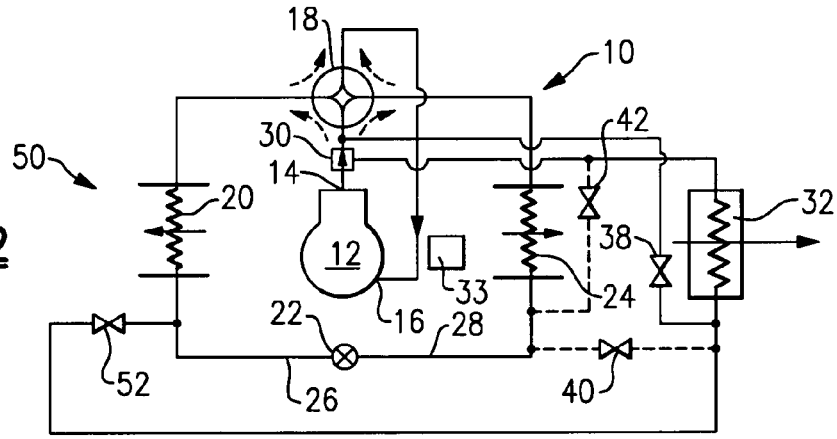
FIG. 2 shows a second schematic.

Another heat pump system schematic 50 is illustrated in FIG. 2. The valves 38, 40 and 42 operate similar to the FIG. 1 embodiment (valves 40 and 42 can be made optional in this case as well). However, another valve 52 is integrated into the system design and provides additional degree of flexibility in the cooling mode of operation, where the reheat coil 32 and the outdoor coil 20 can be configured in a parallel arrangement by opening the three-way valve 30 and the shut-off valve 52 and closing the shut-off valves 38, 40 and 42. Once again, as in FIG. 1 embodiment, in the sequential arrangement for the heating mode of operation, with the reheat coil 32 located upstream of the indoor heat exchanger 24, the control may open the three-way valve 30 and the shut-off valve 38, and close the valves 40, 42 and 52. This would allow refrigerant to flow through the reheat coil 32 prior to entering the indoor heat exchanger 24.

Moreover, analogously to the FIG. 1 embodiment, if the parallel flow arrangement is preferred in the heating mode of operation, then the three-way valve 30 and the shut-off valve 40 are opened, with the shut-off valves 38, 42 and 52 closed. Further, opening the shut-off valves 40 and 42 and closing the shut-off valves 38 and 52 and the three-way valve 30 allows for the refrigerant to pass through the indoor heat exchanger 24 prior to entering the reheat coil 32, in the sequential manner. Lastly, as in FIG. 1 embodiment, the control may allow refrigerant to flow through the reheat coil 32 in an opposite direction, if desired. Obviously, any subsystem of the FIG. 2 embodiment system can be employed by itself, since any auxiliary cycle branch with the associated flow control devices is optional. Again, a worker of ordinary skill in the art would recognize how the various options would be best utilized to meet the desired conditions and design requirements.

Figure 3:
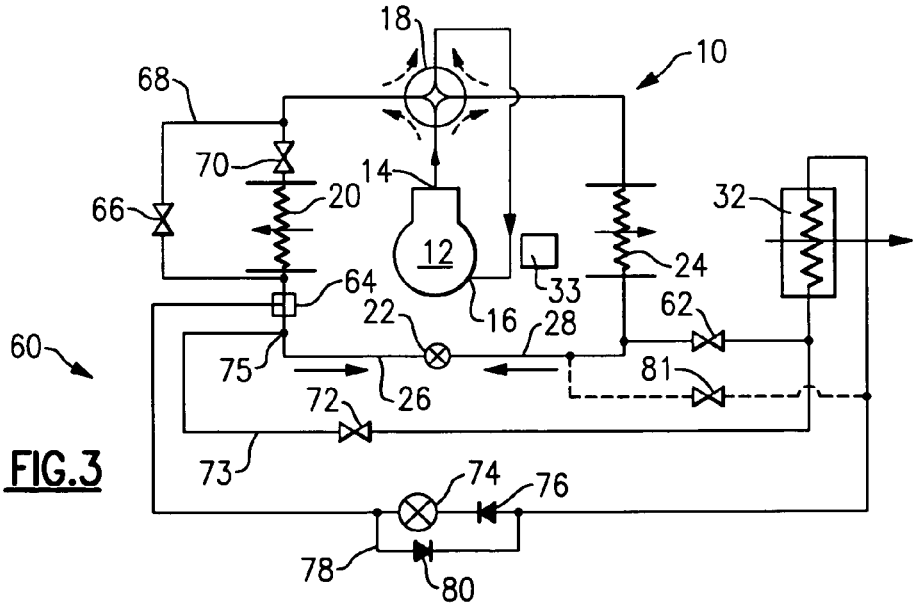
FIG. 3 shows a third schematic.

Another heat pump schematic 60 is illustrated in FIG. 3, wherein a warm liquid or two-phase mixture is utilized in the reheat coil in the cooling mode of operation. In this embodiment, a shut-off valve 62 is added to the design and a shut-off valve 72 replaces the check valve on the return refrigerant line from the reheat coil to the main circuit. As before, cooling and dehumidification modes of operation are not altered, as compared to the conventional design. However, the shut-off valve 72 must be opened during the dehumidification mode of operation. In the heating mode, the refrigerant flow would be reversed through the main circuit of the system as well as through the reheat coil. During heating mode, the valve 62 is opened and the valve 72 is closed. The refrigerant passes through the indoor heat exchanger 24 first, and then through the reheat coil 32. A secondary expansion device 74 is needed in this configuration, when the reheat coil is utilized in the heating mode of operation, and is provided with a check valve 76 to control an amount and appropriate direction of the refrigerant flow during the heating mode, and a bypass line 78 with a check valve 80 to allow flow to the reheat coil 32 around the expansion device 74, when in a cooling mode. Further, a shut-off valve 81 provides an alternative design arrangement in case a single expansion device is to be utilized in both cooling and heating modes of operation.

In addition, a bypass line 68 allows for flow of refrigerant around the outdoor heat exchanger 20. Valves 66 and 70 control the amount of refrigerant flowing thorough and around the outdoor heat exchanger 20. Such a bypass might be utilized when less sensible cooling system capacity is necessary, but dehumidification (latent capacity) would still be desirable.

Figure 4:
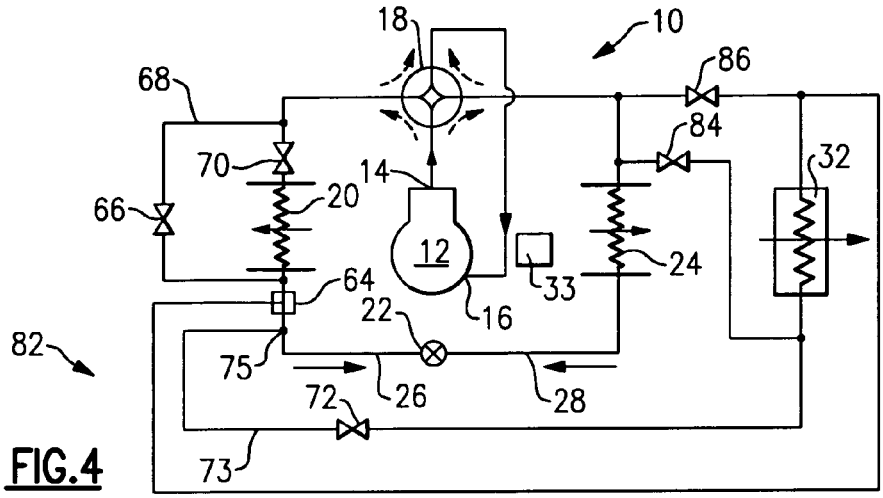
FIG. 4 shows a fourth schematic.

FIG. 4 shows another system schematic 82. This design is similar to the FIG. 3 embodiment design, with the exception that during the heating mode of operation, the refrigerant would pass through the reheat coil 32 first and then through the indoor heat exchanger 24. During the heating mode, the shut-off valves 84 and 86 should be controlled simultaneously to the open position and valve 72 to its closed position.

Figure 5:
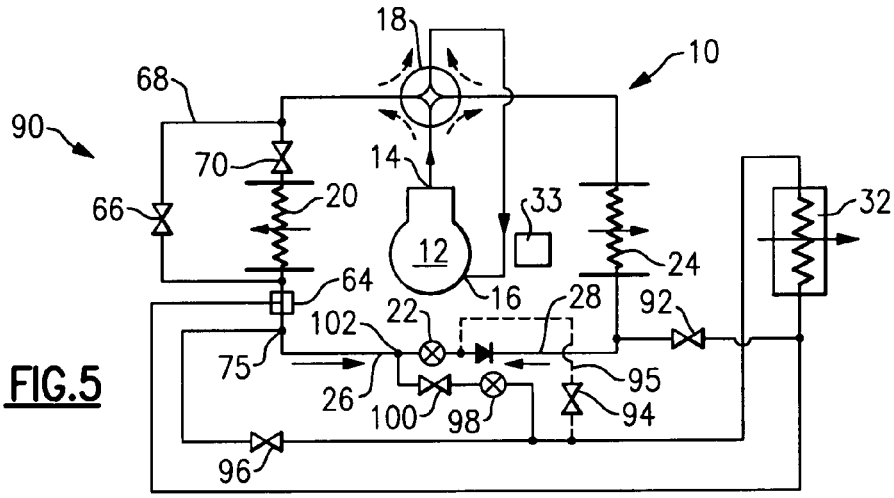
FIG. 5 shows a fifth schematic.

FIG. 5 shows a heat pump system schematic 90. In this design, refrigerant flows through the reheat coil 32 in the same direction in all modes of operation. In the heating mode, refrigerant flows through the indoor heat exchanger 24 and then through the reheat coil 32 in sequence. A shut-off valve 100 is added downstream of a secondary expansion device 98, in case the expansion device is not electronically controlled. Shut-off valves 92 and 96 are also added to the design scheme, the latter to replace the conventional check valve. An optional shut-off valve 94 is located onto a refrigerant line 95 as well. During the heating mode of operation, if the reheat coil 32 is functional, the shut-off valves 92 and 100 are opened, and the valve 96 is closed. If the same expansion device is to be utilized in both heating and cooling modes, then the shut-off valve 94 is opened, and the shut-off valve 100 is closed.

Figure 6:
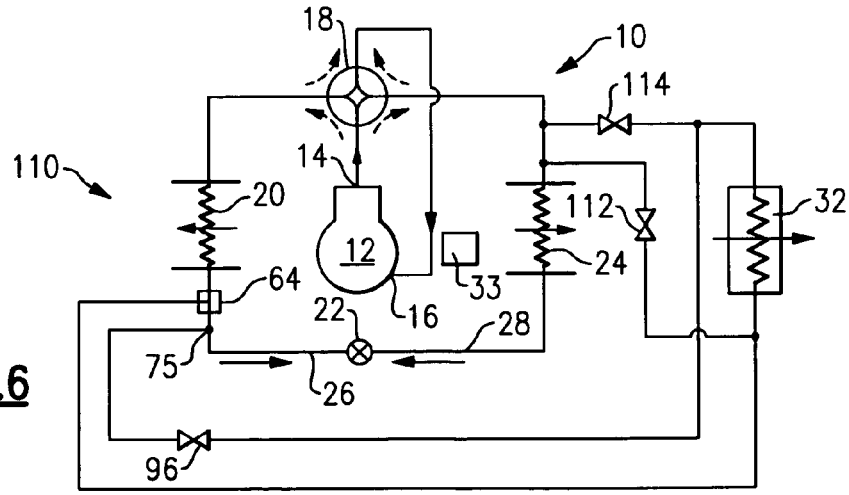
FIG. 6 shows a sixth schematic.

FIG. 6 shows yet another embodiment 110, which is somewhat similar to the FIG. 5 embodiment. In the embodiment 110, refrigerant passes through the reheat coil 32 before it enters the indoor heat exchanger 24 in the heating mode of operation. As before, refrigerant flows in the same direction through the reheat coil 32 in all modes of operation. A shut-off valve 114 is added to the system schematic. During the heating mode, the shut-off valves 112 and 114 are opened and the shut-off valve 96 is closed.

As with all of these embodiments, the location of the inlet and outlet lines leading to the reheat coil can be switched in the heating mode of operation to provide greater control and operational flexibility. Also, all the shut-off valves can be substituted by regulating flow control devices, which would infinitely improve system response to varying external load demands. Furthermore, a single three-way valve can replace a pair of the conventional valves to perform identical bypass functionality around the outdoor coil to obtain a variable sensible heat ratio in the dehumidification mode of operation. A worker ordinarily skilled in the art can design an appropriate control.

Further, a worker of ordinary skill in the art would recognize what controls would be necessary to control the various valves and components of the refrigerant system, and what would be desirable conditions, at which the various controls need to be implemented.

While particular system schematics and reheat circuit concepts are disclosed, it is well understood by a person ordinarily skilled in the art that many other reheat circuit designs could be utilized and will provide the full benefits obtained from the teachings of this invention. Thus, the present invention broadly extends to the integration of a reheat circuit into a heat pump system, which is operable in both heating and cooling modes, and provides advantages of control flexibility over temperature and humidity, in order to satisfy sensible and latent load demands, as well as performance enhancement, reliability improvement and capacity modulation. Such advantages are obtained due to selective operation of the reheat coil in both heating and cooling modes of operation that characterizes the thrust of this invention.

Although preferred embodiments of this invention has been disclosed, a worker of ordinary skill in this art would recognize that certain modifications would come within the scope of this invention. For that reason, the following claims should be studied to determine the true scope and content of this invention.

What is claimed is:

1. A refrigerant system comprising:

a compressor, said compressor compressing refrigerant and delivering the refrigerant to a discharge line, said compressor receiving a refrigerant from a suction line;

an indoor heat exchanger and an outdoor heat exchanger, a main flow control device being operable to send refrigerant from said discharge line through a refrigerant circuit, to said outdoor heat exchanger, to an expansion device and then to said indoor heat exchanger when in a cooling mode, and operable to pass refrigerant through the refrigerant circuit from said discharge line to said indoor heat exchanger, to an expansion device and then to said outdoor heat exchanger when in a heating mode;

a reheat coil, said reheat coil being in communication with the refrigerant circuit to tap refrigerant through a reheat coil, and return said refrigerant to said refrigerant circuit, and an air moving device for passing air to an environment to be conditioned over said indoor heat exchanger, and passing at least a portion of said air over said reheat coil; and a control for selectively operating a reheat circuit flow control device to communicate at least a portion of refrigerant to said reheat coil in both cooling and heating modes of operation, when desired.

2. The refrigerant system as set forth in claim 1, wherein said reheat circuit flow control device is a three-way valve that selectively communicates refrigerant from said refrigerant circuit to said reheat coil.

3. The refrigerant system set forth in claim 1, wherein said main flow control device is a four-way valve.

4. The refrigerant system set forth in claim 1, wherein said reheat coil and said indoor heat exchanger are arranged serially in said heating mode of operation.

5. The refrigerant system set forth in claim 4, wherein said reheat coil is positioned downstream of said indoor heat exchanger.

6. The refrigerant system set forth in claim 4, wherein said reheat coil is positioned upstream of said indoor heat exchanger.

7. The refrigerant system set forth in claim 1, wherein said reheat coil and said indoor heat exchanger are arranged in parallel in said heating mode of operation.

8. The refrigerant system set forth in claim 1, wherein flow through said reheat coil is in the same direction in both said cooling and heating modes of operation.

9. The refrigerant system set forth in claim 1, wherein flow through said reheat coil reverses direction in said cooling and heating modes of operation.

10. The refrigerant system set forth in claim 1, wherein said reheat coil is positioned upstream of said main flow control device.

11. The refrigerant system set forth in claim 1, wherein said reheat coil is positioned downstream of said main flow control device.

12. The refrigerant system set forth in claim 1, wherein said reheat coil has an inlet line positioned upstream of said main flow control device and a return line positioned downstream of said main flow control device.

13. The refrigerant system as set forth in claim 1, wherein a bypass allows selective bypassing of refrigerant around said outdoor heat exchanger.

14. The refrigerant system as set forth in claim 13, wherein said bypass includes a selectively controllable valve.

15. The refrigerant system as set forth in claim 1, wherein said expansion device comprises a pair of expansion devices with one being operational in each of said heating and cooling modes.

16. A method of operating a refrigerant system comprising the steps of:

(1) providing a main flow control device for selectively routing refrigerant through the system for operation in either a cooling or heating mode, through a reheat coil, and through an indoor heat exchanger positioned to be adjacent said reheat coil, such that at least a portion of air passing over said indoor heat exchanger also passes over said reheat coil; and (2) selectively operating said refrigerant system in one of said heating and cooling modes, and selectively routing refrigerant through said reheat coil in both cooling and heating modes, when desired.

17. The method of claim 16, further comprising the steps of providing a bypass around an outdoor heat exchanger, and selectively operating said bypass when desired.

18. The method of claim 16, comprising the further step of providing the flow of refrigerant optionally to said reheat coil either serially with one of said indoor and outdoor heat exchangers, or in parallel with one of said indoor and outdoor heat exchangers, and selectively operating flow control devices to provide a desired flow of refrigerant.

19. The method of claim 16, wherein the selective routing of the refrigerant through the reheat coil is utilized to boost system efficiency in the heating mode of operation.

20. The method of claim 16, wherein the selective routing of the refrigerant through the reheat coil is utilized to provide capacity modulation in the heating mode of operation.

* * * * *